US005558046A

United States Patent [19]

Schoppe et al.

[11] Patent Number: 5,558,046

[45] Date of Patent: Sep. 24, 1996

[54] FIRE-TUBE BOILER

[75] Inventors: Fritz Schoppe; Josef Pröstler, both of Geretsried, Germany

[73] Assignee: Dr.-Ing. Fritz Schoppe, Geretsried, Germany

[21] Appl. No.: 295,693

[22] PCT Filed: Mar. 5, 1992

[86] PCT No.: PCT/DE92/00190

§ 371 Date: Aug. 30, 1994

§ 102(e) Date: Aug. 30, 1994

[87] PCT Pub. No.: WO93/18339

PCT Pub. Date: Sep. 16, 1993

[51] Int. Cl.[6] ..... F22B 7/12; F22B 37/06

[52] U.S. Cl. ..... 122/367.1

[58] Field of Search ..... 122/367.1, 367.2

[56] References Cited

U.S. PATENT DOCUMENTS

| | | | |
|---|---|---|---|
| 3,618,572 | 11/1971 | Nauert | 122/367.1 |
| 3,672,839 | 6/1972 | Moore | 122/367.1 |
| 3,857,367 | 12/1974 | Giesen | 122/367.1 |
| 4,055,152 | 10/1977 | Vidalenq | 122/367.3 |
| 4,109,614 | 8/1978 | Viessmann | 122/367.3 |
| 4,327,672 | 5/1982 | Viessmann | 122/367.1 |
| 4,398,848 | 7/1983 | Siebelt | 122/367.3 |
| 4,499,859 | 2/1985 | Nishiguchi et al. | 122/367.3 |
| 4,720,263 | 1/1988 | Green | 122/367.3 |
| 5,273,002 | 12/1993 | Balint et al. | 122/367.3 |

FOREIGN PATENT DOCUMENTS

| | | |
|---|---|---|
| 152203 | 2/1903 | Germany . |
| 357283 | 8/1922 | Germany . |
| 1049038 | 1/1959 | Germany . |
| 2826048 | 12/1979 | Germany . |
| 3106421 | 1/1982 | Germany . |

OTHER PUBLICATIONS

M. Ledinegg, Dampferzeugungs–Dampfkessel, Feuerungen Dec. 1966, pp. 5, 6.

*Primary Examiner*—Marguerite McMahon
*Attorney, Agent, or Firm*—Brooks Haidt Haffner & Delahunty

[57] ABSTRACT

A fire-tube boiler which is suitable for operation with powdered ash-containing fuels and automatically maintains itself clean in operation, has inlet openings, widening in trumpet shape, of flue tubes in the wall which separates the boiler drum from a reversing chamber. The fire tube is so dimensioned that, with due consideration of the boiler capacity, the flue gases at the outlet from the fire tube are cooled by a safety margin to below the ash-softening point of the corresponding fuel. The number and inside diameter of the flue tubes are so dimensioned that a dynamic pressure which is not less than 40 Pa is established in them. A blast tube which blows approximately tangentially over the partition wall is arranged on the reversing chamber in order to keep the inlet openings free of deposits of ash.

13 Claims, 3 Drawing Sheets

FIRE-TUBE BOILER

The present invention relates to a fire-tube boiler.

Fire-tube boilers are generally known. They consist of a horizontal cylindrical boiler drum having one or more fire tubes therein, into each of which a burner introduces hot gases at one end. At the other end, the flue gases which are already cooled and have temperatures of generally 700° C. to 1000° C. leave the fire tube and enter a reversing chamber where they are deflected and fed to a flue line which consists of a bundle of parallel flue tubes which extend through the boiler drum below the fire tube.

These drums are used for firing with oil and gas for the production of steam, hot water, etc. They operate satisfactorily when said fuels are used.

When firing with powdered solid ash-containing fuels, however, serious problems due to dirtying of the boiler occur with such fire-tube boilers. Since, in particular, larger particles of fuel are in a pasty state for a long time during the combustion process, they can, when impinging upon cool walls adhere to them, solidify and build up slag deposits the elimination of which is difficult. As a general rule, for this purpose, the feed water must be removed from the boiler so that the boiler cools rapidly, which means a considerable loss of feed water and long standstill periods. Fire-tube boilers fired with ash-containing powdered fuels have therefore not been able to gain substantial acceptance.

The object of the present invention is to provide a fire-tube boiler of the aforementioned type which is suitable for firing with ash-containing powdered solid fuels without danger of dirtying.

The object of the invention is achieved by providing a fire-tube boiler operated with ash-containing flue gases and containing, in a boiler drum, at least one horizontally arranged fire tube which is provided at one end with an extension for the connecting of the burner, a reversing chamber at one end of the boiler drum into which an outlet of the fire tube debouches at the other end thereof, and a plurality of flue tubes which have an inside diameter 2R and extend, starting from the reversing chamber, below the fire tube through the boiler drum, wherein each of the flue tubes has an inlet opening which widens from the inside diameter (2) in the direction towards the reversing chamber into which it debouches, in trumpet-like manner with a radius of curvature r over an axial distance of approximately r, r/R being >0.3, the dimensions of the fire tube, with due consideration of the boiler capacity and the desired temperature of the boiler water, are so selected that, in operation, the temperature of the flue gases at the outlet end of the fire tube lies a safety margin below the ash-softening temperature of the corresponding fuel, and the number and inside diameter (2) of the flue tubes are so dimensioned that the dynamic pressure in the flue tubes at a point directly behind the trumpet-shaped widening is greater than 40 Pa.

Three groups of features contribute to the success achieved by the invention, namely:

a) the inlet openings of the flue tubes are developed trumpet-shaped in a special manner so as to obtain favorable conditions of flow there which substantially exclude the formation of shadows, b) the dimensions of the fire tube are so selected that the flue gases upon emergence from the fire tube are cooled, with a safety margin, below the ash-softening point, and c) the number and cross sections of the flue tubes are so dimensioned that there are present in the cylindrical portion of the tube inlet predetermined dynamic pressures which are necessary in order to avoid the depositing of ash in the flue tubes.

The dimensions of the fire tube which are necessary in order to obtain said sufficient cooling of the flue gases to below the ash softening point can be calculated from the heat transfer by radiation and convection, with due consideration of the wall temperature and the laws of fluid mechanics. In this connection, reference is had to the VDI Heat Atlas from which corresponding information can be obtained. The number of tubes and their cross section determines, for a given boiler capacity, the velocity of flow and thus the dynamic pressure of the flue gases in the flue tubes. From the boiler capacity, the total amount of air can namely be calculated via the amount of fuel and the air excess for complying with the provisions of the TA Air, the total amount of air and, from this, the amount of offgas which, in its turn, with a predetermined dynamic pressure in the flue tubes, determines their number and cross section. Said dynamic pressure is thus specific to each individual boiler.

The protection of the boiler of the invention from dirtying by the baking of ash components onto the particularly endangered inlet openings of the flue tubes can be further improved if these inlet openings are blown at more or less regular intervals, by a burst of compressed air. As a further development of the invention, therefore, at least one side wall of the reversing chamber is passed through by at least one blast tube the direction of the blast of which is at least approximately parallel to the partition wall having the blast-tube inlet openings which separates the reversing chamber from the boiler drum, the blast cross section of said tube extending over all flue-tube inlet openings. This blast tube is preferably connected by a valve to a gas pressure accumulator which need have only a relatively small volume and stores air, for instance, under a pressure of 6000 to 8000 hPa. With this compressed air, a pressure burst of a duration of about 0.1 sec is produced at intervals of 0.5 to 4 hours, it spreading out with the speed of sound and passing over the entire field of the inlet openings of the flue tubes.

It is furthermore advantageous if blast tubes by which deposits in the region of the inlet openings can be blown away are arranged opposite the inlet openings of the flue tubes in the opposite end wall of the reversing chamber. It is furthermore advantageous also to provide in the burner-side end wall of the fire tube, one or more blast nozzles by which steam or compressed air can be blown continuously or in bursts into the fire tube so as to remove deposits of ash from the wall of the fire tube.

The invention will be described in further detail with reference to embodiments shown in the drawing, in which.

Figure 1:
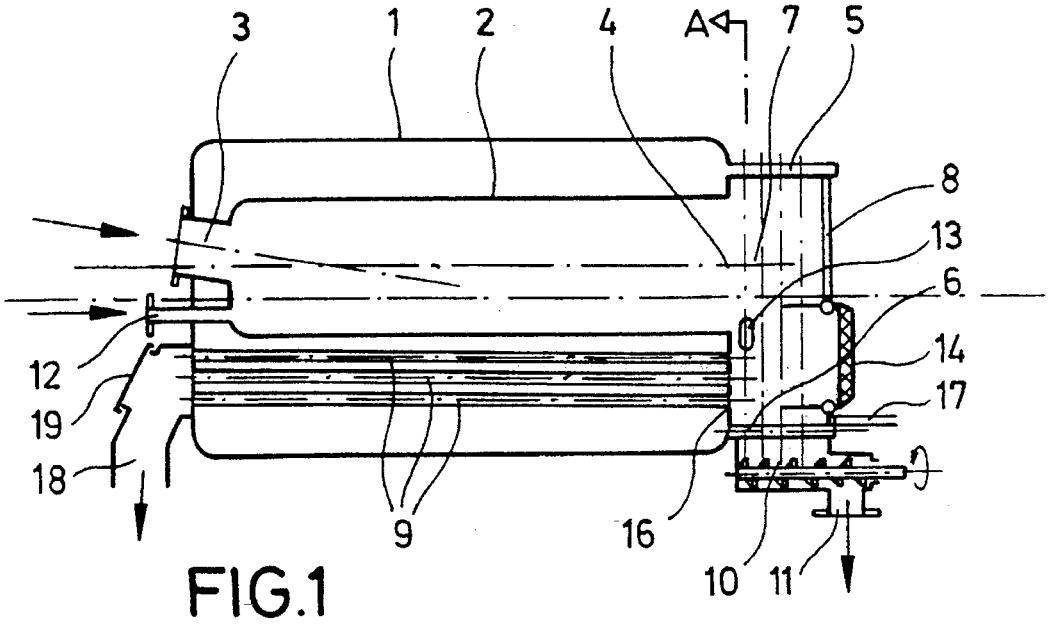
FIG. 1 is a basic diagram of a boiler in accordance with the invention (without burner), shown in longitudinal section.

The fire-tube boiler consists of an outer boiler drum 1 and one or more cylindrical fire tubes 2 arranged therein. In the example shown in FIGS. 1 and 2, there is only one fire tube 2. At its one end, an extension 3 is developed for the attachment of a burner, which is not shown in the present example. This extension 3 can be arranged in or off the axis of the fire tube 2, and the axis of the extension 3 can be parallel or inclined to the axis of the fire tube 2. If the extension 3 for the burner lies off the axis of the fire tube 2 and inclined to its axis, as shown in FIG. 1, so that the burner blows obliquely downward, then the momentum of the fire gases advantageously blows deposits of ash off from the bottom of the fire tube 2.

The fire tube 2 debouches at its other end into a reversing chamber 4 which is formed by an upper water collector 5, two lower water collectors 6' and 6" (FIG. 2), as well as side walls 7, a bottom wall 23, and a rear end wall 8. These walls are advisedly developed as water-cooled membrane walls.

A flue-tube line consisting of a plurality of flue tubes which are parallel to each other extends below the fire tube 2 through the boiler drum 1. These flue tubes 9 have inlet openings at a partition wall 16 which separates the boiler drum 1 from the reversing chamber 4. At the other end, the flue tubes debouch into a flue gas collection space 18.

Below the reversing chamber 4, the two lower water collectors 6 and 6' form, between each other, an opening through which ash and other particles of dirt can drop downward out of the reversing chamber 4. The opening debouches into a trough 24 in which there is a conveyor worm 10 by which the particles of ash are conveyed away into an outlet opening 11.

Below the extension 3 for the burner, there debouch into the fire tube 2. one or more blast tubes 12 through which pressurized gas, for instance steam or air, can be blown continuously or in pressure bursts over the walls of the fire tube 2 in order to blow deposits of ash from there in the direction towards the reversing chamber.

On a further blast tube 13, which extends through one of the side walls 7 of the reversing chamber 4, provision is made for blowing bursts of air under pressure tangentially or at a slight angle over the partition wall 16 in the region where the inlet openings of the flue tubes 9 are arranged. In accordance with FIGS. 4 and 5, the blast tube 13 is connected via a valve 20 with a pressure accumulator 21 which is supplied with compressed air by a pressure pump 22. The valve 20, which can be a solenoid valve, the pressure accumulator 21 and the pump 22 are only diagrammatically indicated in FIG. 4.

Through the blast tubes 12 a part of the combustion air can be blown in, which has a favorable effect on the obtaining of low contents of CO and $NO_x$. Furthermore, steam or compressed air can be fed continuously or in bursts to these blast tubes.

In order to keep the inlet openings of the flue tubes 9 clean, it is sufficient if pressure bursts are fed at time intervals of 0.5 to 4 hours via the blast tube 13. As an alternative, however, it is also possible continuously to feed air via the blast tube in order to control the composition of the offgas.

Figure 2:
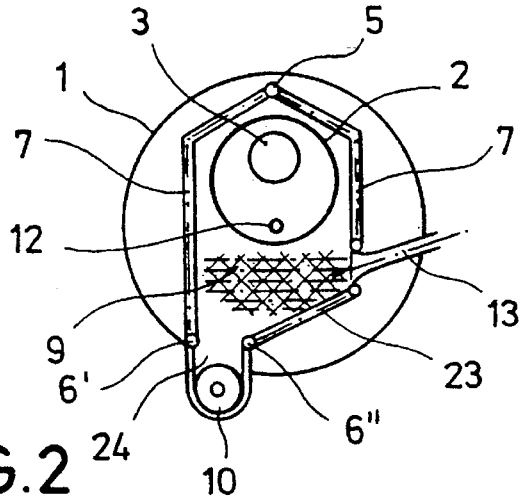
FIG. 2 is a cross section through the reversing chamber.

In FIG. 2, which is cross section along the line A—A of FIG. 1, there can be noted the reversing chamber 4, looking at the fire tube 2 and the flue tubes 9. The fire tube 2, a blast tube 12 below it, and the water collectors 5, 6' and 6" can be noted. The lower water collectors 6' and 6" are arranged eccentrically and make it possible for the jet action of the blast tube 13, when it spreads out in the known jet angle, to cover all of the inlet openings of the flue tubes 9 and blow away deposits which may have formed there on the partition wall 16. For this reason, the bottom wall 23 of the reversing chamber 4 is preferably inclined and leads to the aforementioned opening between the two lower water collectors 6' and 6" into the said trough 24.

Figure 3:
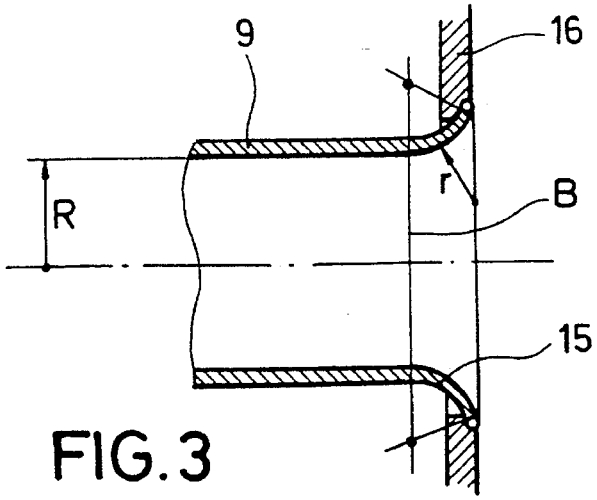
FIG. 3 is an enlarged showing of the inlet opening region of a flue tube.

FIG. 3 shows a section through the inlet region of one of the flue tubes 9 at the partition wall 16 which separates the boiler drum 1 from the reversing chamber 4. The flue tube 9 has an inner radius R and is rounded in trumpet fashion at the inlet end, having an inner radius of curvature r. The rounding has an axial length of for instance the value r.

This region is particularly critical with respect to deposits of burning particles of ash which are still in a pasty state. Upon entrance into the flue tube 9, they might not entirely follow too sharp a deflection as a result of too small an inner radius of curvature r and form collar-like deposits around the inlet around the flue tube 9, the deposits then solidifying under the cooling action of the water-cooled walls and forming very hard crusts. Such deposits are avoided in the manner, in accordance with the invention, that the ratio r:R is greater than 0.30, and preferably between 0.50 and 0.80.

This measure by itself is not sufficient to keep the flue-tube inlet clean. With gas velocities in the flue tubes 9 which are too small, ash will drop out along the flue tubes 9 and cover their bottoms, assuming a dune-like shape after a short time. The crests of the dunes travel in operation with a speed of about 1 meter per second, and therefore considerably slower than the speed of the flue gases which flow through the flue tubes 9. Upon reaching the outlet cross section of a flue tube, each dune crest produces a pressure pulse which results for a short time in a high flue-gas velocity in the flue tube 9, whereupon the velocity of flow of the flue gases is again reduced by the formation of the nest dune crest. This irregular change in the velocity of the flue gas in the flue tubes 9 contributes essentially to the forming of collar-like ash incrustation in the region of the inlet openings of the flue tubes 9. This is further avoided in accordance with the invention in the manner that, by suitable dimensioning of number and cross sections of the flue tubes, the velocity of the flue gas is so adjusted at the cross section B where the cylindrical region of the flue tubes 9 commences, that the corresponding dynamic pressure is always greater than 40 Pa and maintains a safety distance from this limit. The dynamic pressure in the region is preferably between 80 and 200 Pa. Even higher dynamic pressures can lead to dynamic effects (pulsations) of the mass of flue gases in the flue tubes 9 in combination with the elasticity and supply of energy of the hot gases in the fire tube 2. This means that the region of the dynamic pressures of 40 to 200 Pa is available for the control region of the throughput of flue gas. Since the dynamic pressure increases as the square of the velocity, there results from this a control range in the flue gas throughput of about 1:2.5. In this connection, the upper value of 200 Pa also still contains a top safety margin.

For the optimizing of the CO— and $NO_x$ values, further blast tubes 17 can be provided in the region of the reversing chamber 4, which, particularly if burning oversize particles are still present in the region of the fire-tube exit cross section into the reversing chamber, feed them further oxygen for their complete burning. These blast tubes 17 can advisedly be so arranged that identical oxygen contents are present at all inlet cross sections B of the flue tubes 9.

The rear end wall 8 of the reversing chamber 4 can have doors 14 through which the inlet openings of the flue tubes 9 and the lower region of the fire tube 2 are accessible.

Figure 4:
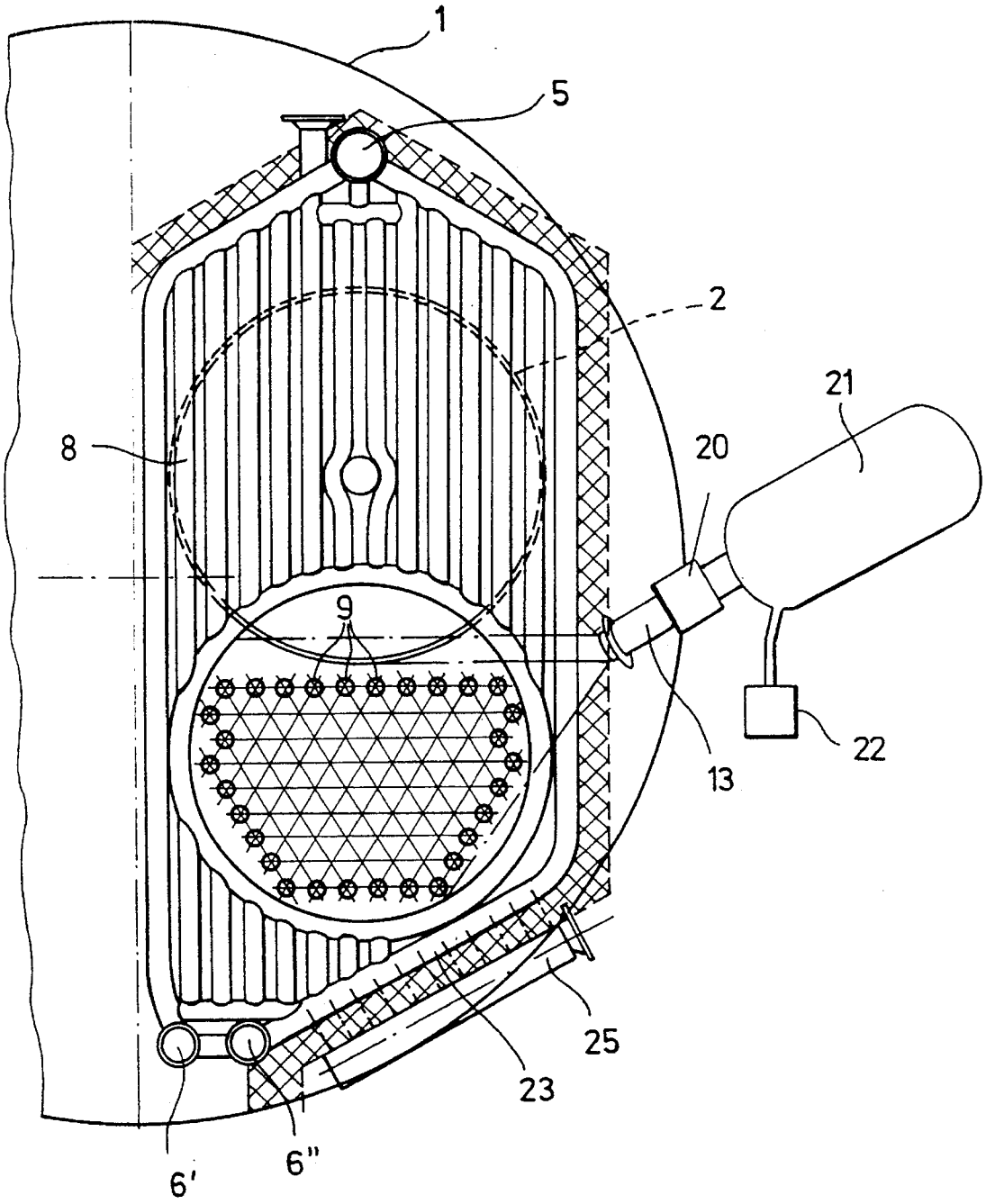
FIG. 4 is a partial showing in the rear region of a boiler having two fire tubes, seen from the end.

FIG. 4 shows an embodiment of the invention in which two fire tubes 2 are arranged in the boiler drum 1, only one of said fire tubes being shown in FIG. 4 for reasons of clarity of the drawing. The other fire tube with corresponding reversing chamber and other parts is arranged as a mirror image. In FIG. 4, one can note, with the end-wall cover 14 removed, the field of the inlet openings into the flue tubes 9 and furthermore the blast tube 13 with valve 20 and pressure accumulator 21, the blast cross section of the blast tube 13 being shown in dash-dot line and passing, as can be noted, over the entire field of the inlet openings of the flue tubes 9. The direction of flow of the blast tube 13 is substantially obliquely downward in order to blow blown-off deposits of ash into the outlet between the lower water collectors 6' and 6". There can furthermore be noted in FIG. 4, below the oblique bottom wall 23 of the reversing chamber, a feed tube 25 for additional air which has outlets, indicated diagrammatically in dot-dash line, which debouch into the reversing chamber 4.

Figure 5:
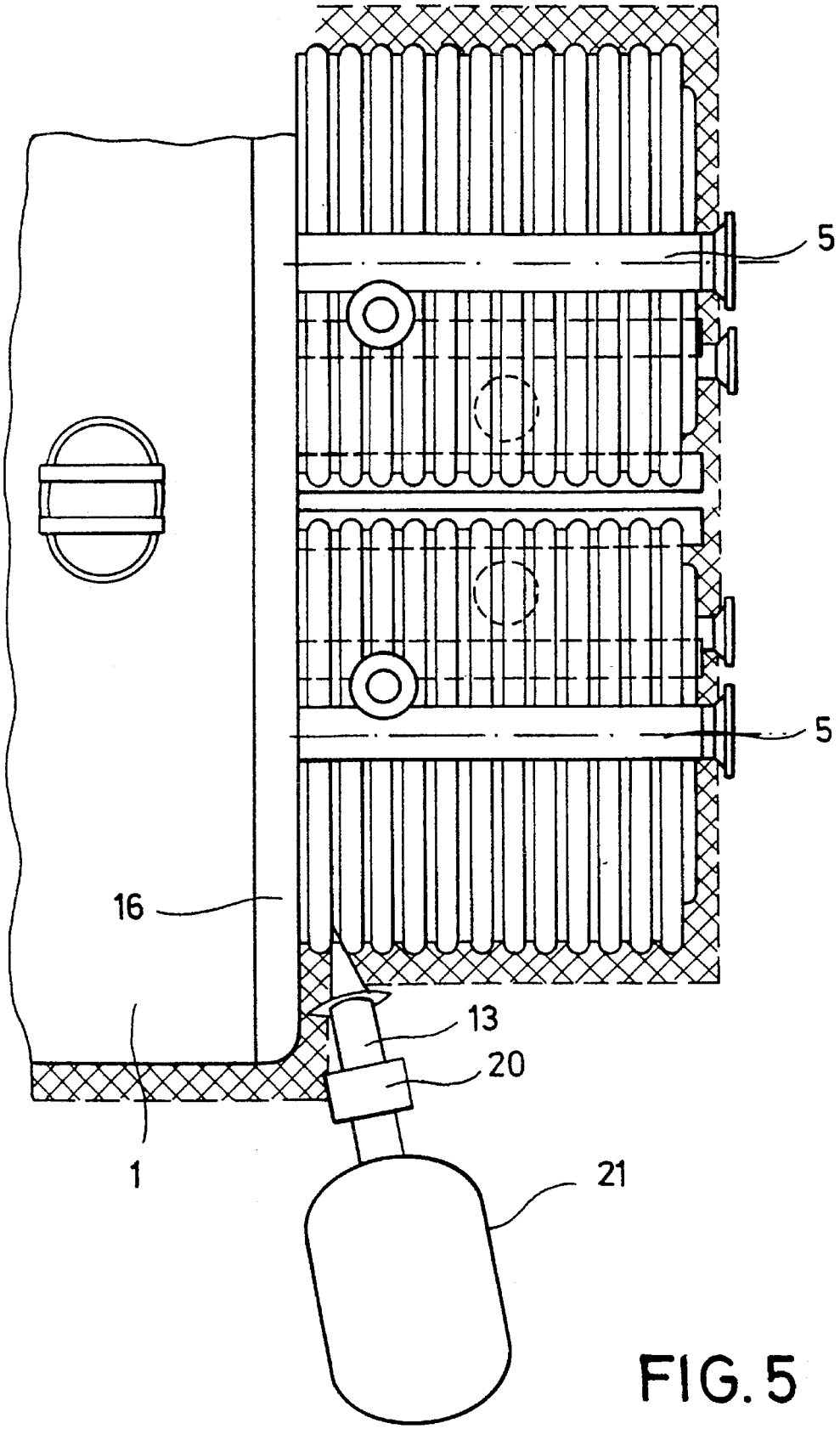
FIG. 5 is a partial showing of the rear region of the boiler of FIG. 4, seen from above.

FIG. 5 is a top view of the arrangement of FIG. 4, in which there can be noted two reversing chambers which are arranged in twin arrangement on both sides of the center of the boiler drum 1. In the embodiment shown, only one of the blast tubes 3 with attached pressure collector 21 has been shown for reasons of clarity of the drawing, this figure being intended essentially to show that the blast tube 13 blows approximately tangentially over the partition wall 16 which separates the boiler drum from the reversing chambers 4.

The boiler construction is also suitable for the burning of liquid sulfur-containing fuels, if a lime-containing absorbent, for instance calcium hydroxide, is added. Such powdered admixtures then behave similar to the ash in the case of ash-containing powered fuels.

The same applies to fuels containing sulfur and ash in which the sulfur is to be bound in the ash by low-temperature desulfurization. This takes places well in particular if the ash contains sufficient lime or similarly active components or if a lime-containing absorbent is added to the fuel. Upon the burning of such fuels; in the fire-tube boiler of the invention, an ash which is particularly surface active or a particular activating of the lime-containing components is obtained so that, upon the cooling of the flue gases down to 10° to 15° C. above the actual condensation point of the combustion offgases, the sulfur is completely bound in the ash or the lime-containing components.

With the fire-tube boiler of the invention, there are obtained, at the outlet cross section of the fire tube 2 into the reversing chamber 4, offgas temperatures which are below the softening temperature of the completely burned ash particles. In boilers of ordinary size, particles of up to 0.2 to 0.3 mm size can burn out in fire tubes. Larger particles enter the reversing chamber 4 and the flue tubes 9 in burning, pasty state. The softening temperatures of the burned-out ash of the different types of coal dust are customarily between 950° and 1250° C. The boiler is therefore so designed in order to avoid the baking-on of such particles of ash that the flue gases at the outlet from the outlet cross section of the fire tube 2 have a temperature which lies a safety margin above the said ash-softening temperature.

At the outlet end of the flue tubes 9 below the extension 3 for the burner, a flue-gas collecting space 18 for the removal of the cooled flue gases is arranged. It has an access door 19 through which the inside of the flue tubes 9 can be inspected and, in case of disturbance, cleaned in customary manner by the pushing-through of long bars, the deposits which are pushed out dropping into the trough 24 and being carried away by the screw 10.

We claim:

1. A fire-tube boiler operated with ash-containing flue gases and containing, in a boiler drum, at least one horizontally arranged fire tube which is provided at one end with an extension for the connecting of the burner, a reversing chamber at one end of the boiler drum into which an outlet of the fire tube debouches at the other end thereof, and a plurality of flue tubes which have ann inside diameter 2R and extend, starting from the reversing chamber, below the fire tube through the boiler drum, wherein each of the flue tubes has an inlet opening which widens from the inside diameter (2) in the direction towards the reversing chamber into which it debouches, in trumpet-like manner with a radium of curvature r over an axial distance of approximately r, r/R being >0.3, the dimensions of the fire tube, with due consideration of the boiler capacity and the desired temperature of the boiler water, are so selected that, in operation, the temperature of the flue gases at the outlet end of the fire tube lies a safety margin below the ash-softening temperature of the corresponding fuel, and the number and inside diameter (2) of the flue tubes are so dimensioned that the dynamic pressure in the flue tubes at a point directly behind the trumpet-shaped widening is greater than 40 Pa.

2. A fire-tube boiler according to claim 1, wherein 0.8>r/R>0.5.

3. A fire-tube boiler according to claim 1 or 2, wherein the number and the inside diameter (2) of the flue tubes are so dimensioned that the dynamic pressure in the flue tubes at the point directly behind the trumpet-shaped widening is between 80 and 200 Pa.

4. A fire-tube boiler according to claim 1 or 2, wherein the fire tube is provided, below the extension for the connection of a burner, with at least one blast tube which debouches into the fire tube.

5. A fire-tube boiler according to claim 1 or 2, wherein the reversing chamber is provided with a plurality of blast tubes which have mouths which are opposite the inlet openings of the flue tubes.

6. A fire-tube boiler according to claim 1 or 2, wherein at least one side wall of the reversing chamber is passed through by at least one blast tube the direction of blast of which is at least approximately parallel to a partition wall having the flue-tube inlet opening which separates the reversing chamber from the boiler drum and the cross section of the blast jet of which passes over all flue tube inlet openings.

7. A fire-tube boiler according to claim 6, wherein said at least one blast tube is connected via a valve to a gas pressure accumulator.

8. A fire-tube boiler according to claim 6, wherein the direction of the jet of at least one blast tube forms an angle of about 10° with the partition wall.

9. A fire-tube boiler according to claim 1 or 2 wherein the reversing chamber has an ash outlet in its lower region.

10. A fire-tube boiler according to claim 9, wherein the reversing chamber has an obliquely downward extending bottom wall and the ash outlet is arranged asymmetric to the center plane of the reversing chamber at the lower end of the bottom wall.

11. A fire-tube boiler according to claim 9, wherein a blast tube the direction of blast of which is directed at the ash outlet debouches into the reversing chamber in the lower region thereof.

12. A fire-tube boiler according to claim 1 or 2, wherein a side wall of the reversing chamber is passed through by a blast tube the direction of blast of which is at least approximately parallel to a partition wall having the flue tube inlet openings which separates the reversing chamber from the boiler drum and the cross section of the blast jet of which passes over all flue tube inlet openings; that said blast tube is connected via a valve to a gas pressure accumulator, the reversing chamber has an oblique bottom wall which extends obliquely downward commencing from the side wall having the blast tube; and that an ash-outlet is arranged at the lower end of the bottom wall asymmetric to the center plane of the reversing chamber.

13. A fire-tube boiler according to claim 1 or 2, wherein the flue tubes debouch at the outlet side into a flue-gas collecting space which has an access door for inspecting the inside of the flue tubes.

* * * * *

UNITED STATES PATENT AND TRADEMARK OFFICE

CERTIFICATE OF CORRECTION

PATENT NO. : 5,558,046
DATED : September 24, 1996
INVENTOR(S) : Fritz Schoppe, Josef Prostler It is certified that error appears in the above-indentified patent and that said Letters Patent is hereby corrected as shown below:

Column 1, line 43, change "(2)" to --(2R)--;

line 53, change "(2)" to --(2R)--.

Column 3, line 14, after "tubes" insert --9--.

Column 5, line 32, delete the semicolon (;).

Column 6, line 5, change "(2)" to --2R)--;

line 15, change "(2)" to --(2R)--;

line 22, change "(2)" to --(2R)--.

Signed and Sealed this

Twenty-first Day of January, 1997

*Attest:*

BRUCE LEHMAN

*Attesting Officer*

*Commissioner of Patents and Trademarks*